US007504878B2

(12) United States Patent
Lin

(10) Patent No.: US 7,504,878 B2
(45) Date of Patent: Mar. 17, 2009

(54) DEVICE HAVING TEMPERATURE COMPENSATION FOR PROVIDING CONSTANT CURRENT THROUGH UTILIZING COMPENSATING UNIT WITH POSITIVE TEMPERATURE COEFFICIENT

(75) Inventor: Tser-Yu Lin, Hsin-Chu (TW)

(73) Assignee: MediaTek Inc., Hsin-Chu Hsien (TW)

( * ) Notice: Subject to any disclaimer, the term of this patent is extended or adjusted under 35 U.S.C. 154(b) by 0 days.

(21) Appl. No.: 11/428,542

(22) Filed: Jul. 3, 2006

(65) Prior Publication Data

US 2008/0001648 A1 Jan. 3, 2008

(51) Int. Cl.
*G05F 1/567* (2006.01)

(52) U.S. Cl. ..... 327/540; 327/513; 323/313

(58) Field of Classification Search ..... None
See application file for complete search history.

(56) References Cited

U.S. PATENT DOCUMENTS 4,868,485 A 9/1989 Ashizaki
5,325,045 A * 6/1994 Sundby ..... 323/313
5,382,841 A * 1/1995 Feldbaumer ..... 326/30
5,501,517 A 3/1996 Kiuchi
5,910,749 A * 6/1999 Kimura ..... 327/541
6,011,428 A * 1/2000 Tsukude et al. ..... 327/541
6,087,820 A * 7/2000 Houghton et al. ..... 323/315
6,211,661 B1 4/2001 Eckhardt
6,326,855 B1 12/2001 Jelinek et al.
6,351,111 B1 * 2/2002 Laraia ..... 323/315
6,452,437 B1 9/2002 Takeuchi et al.
6,496,057 B2 * 12/2002 Wada et al. ..... 327/543
6,690,228 B1 * 2/2004 Chen et al. ..... 327/538
6,717,457 B2 * 4/2004 Nanba et al. ..... 327/513
7,046,055 B2 * 5/2006 Lee et al. ..... 327/143
7,208,931 B2 * 4/2007 Aota ..... 323/315
7,236,061 B2 * 6/2007 Lin ..... 331/66
7,274,174 B2 * 9/2007 Wang et al. ..... 323/224
7,358,795 B2 * 4/2008 Kamata ..... 327/538

* cited by examiner

*Primary Examiner*—Lincoln Donovan
*Assistant Examiner*—Terry L Englund
(74) *Attorney, Agent, or Firm*—Winston Hsu

(57) ABSTRACT

A device, having temperature compensation, includes a constant voltage provider for providing a constant voltage; and a compensating load coupled to the constant voltage provider for providing a resistive load to transform the constant voltage into a substantially constant current. The compensating load contains a resistor, having a negative temperature coefficient and coupled to the constant voltage; and a compensating unit, having a positive temperature coefficient and coupled in series to the resistor, for compensating a resistance variation of the resistor for a temperature variation.

18 Claims, 14 Drawing Sheets

DEVICE HAVING TEMPERATURE COMPENSATION FOR PROVIDING CONSTANT CURRENT THROUGH UTILIZING COMPENSATING UNIT WITH POSITIVE TEMPERATURE COEFFICIENT

BACKGROUND

The present invention relates to a device for providing constant current, and more particularly, to a device having temperature compensation for providing a substantially constant current through utilizing a compensating unit with a positive temperature coefficient.

In many analog integrated circuits, a constant voltage or a constant current source is needed for the operation of the whole circuit. The constant voltage source or the constant current source, therefore, plays an important role and can deeply affect the system performance. Usually, in a constant current source circuit, there is a band-gap block used as a temperature-independent voltage generating circuit to supply a constant voltage which is transformed into current by utilizing a resistive load. Considering no other factors, the induced current is a constant current. Please refer to FIG. 1. FIG. 1 is a diagram illustrating a structure of a related art constant current source 100. As shown in FIG. 1, the constant current source 100 includes a band-gap block 110 for providing a constant voltage $V_{BP}$; an operational amplifier 120, coupled to the band-gap block 110, for receiving the constant voltage $V_{BP}$ and a load voltage $V_{load}$ as a negative feedback to hold the load voltage $V_{load}$ equal to the constant voltage $V_{BP}$ by outputting an output voltage $V_{out}$; a current source 130, coupled to the operational amplifier 120, for receiving the output voltage $V_{out}$ to provide the load voltage $V_{load}$ and to provide a necessary amount of current to be drained; and a resistor 140, coupled to the load voltage $V_{load}$, for transforming the constant load voltage $V_{load}$ into a substantially constant current $I_{const}$ drained from the above current source 130.

However, in practice, a resistive value (resistance) of the resistor 140 varies slightly when the resistor 140 experiences a temperature variation. This causes a magnitude of the current $I_{const}$ to fluctuate due to a temperature variation and thus makes the constant current source 100 fail to maintain a constant current as desired.

In a related art technique, the above-mentioned resistor 140 is replaced by a compensating load that is composed of a resistor and an NMOS transistor that is operated in the saturation region. Please refer to FIG. 2. FIG. 2 is a schematic diagram of a compensating load 200 according to the related art. The compensating load 200 includes a resistor 210 and an NMOS transistor 220. The resistor 210 possesses a positive temperature coefficient such that as the ambient temperature increases, the resistive value (resistance) of the resistor 210 increases accordingly, leading to a current flowing through the resistor 210 to decrease. However, since the threshold voltage of the NMOS transistor 220 also decreases when the ambient temperature increases, there will be a larger voltage drop across the resistor 210 compared to an original voltage drop across the resistor 210 before the ambient temperature changes. This reduces the current flowing through the resistor 210, but increases a voltage drop across the resistor 210. Thus this compensating load 200 is able to compensate the current for the temperature variation. Nevertheless, the related art technique is limited to compensating for a resistor with positive temperature coefficient. Very often, rather than a resistor with a positive temperature coefficient, one needs to compensate for a resistor with a negative temperature coefficient. For example, in VLSI, a resistive device can be composed of poly silicon and may possess negative temperature coefficient for a resistive value corresponding to the resistive device. Therefore, in order to stabilize the current flowing through a resistor with a negative temperature coefficient, it is desired to provide a compensating mechanism satisfying this constant current requirement.

SUMMARY

It is therefore one of the objectives of the claimed invention to provide a device having temperature compensation for a resistor with a negative temperature coefficient to supply a substantially constant current, to solve the above-mentioned problems.

The claimed invention provides a device having temperature compensation. The device includes a constant voltage provider for providing a constant voltage; and a compensating load coupled to the constant voltage provider for providing a resistive load to transform the constant voltage into a substantially constant current. The compensating load contains a resistor, having a negative temperature coefficient and coupled to the constant voltage; and a compensating unit, having a positive temperature coefficient and coupled in series to the resistor, for compensating a resistance variation of the resistor for a temperature variation.

The claimed invention further provides a device having temperature compensation. The device includes a constant voltage provider for providing a constant voltage; and a compensating load coupled to the constant voltage provider for providing a resistive load to transform the constant voltage into a substantially constant current. The compensating load contains a resistor, having a negative temperature coefficient and coupled to the constant voltage; and a compensating unit, having a positive temperature coefficient and coupled in parallel to the resistor, for compensating a resistance variation of the resistor for a temperature variation.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
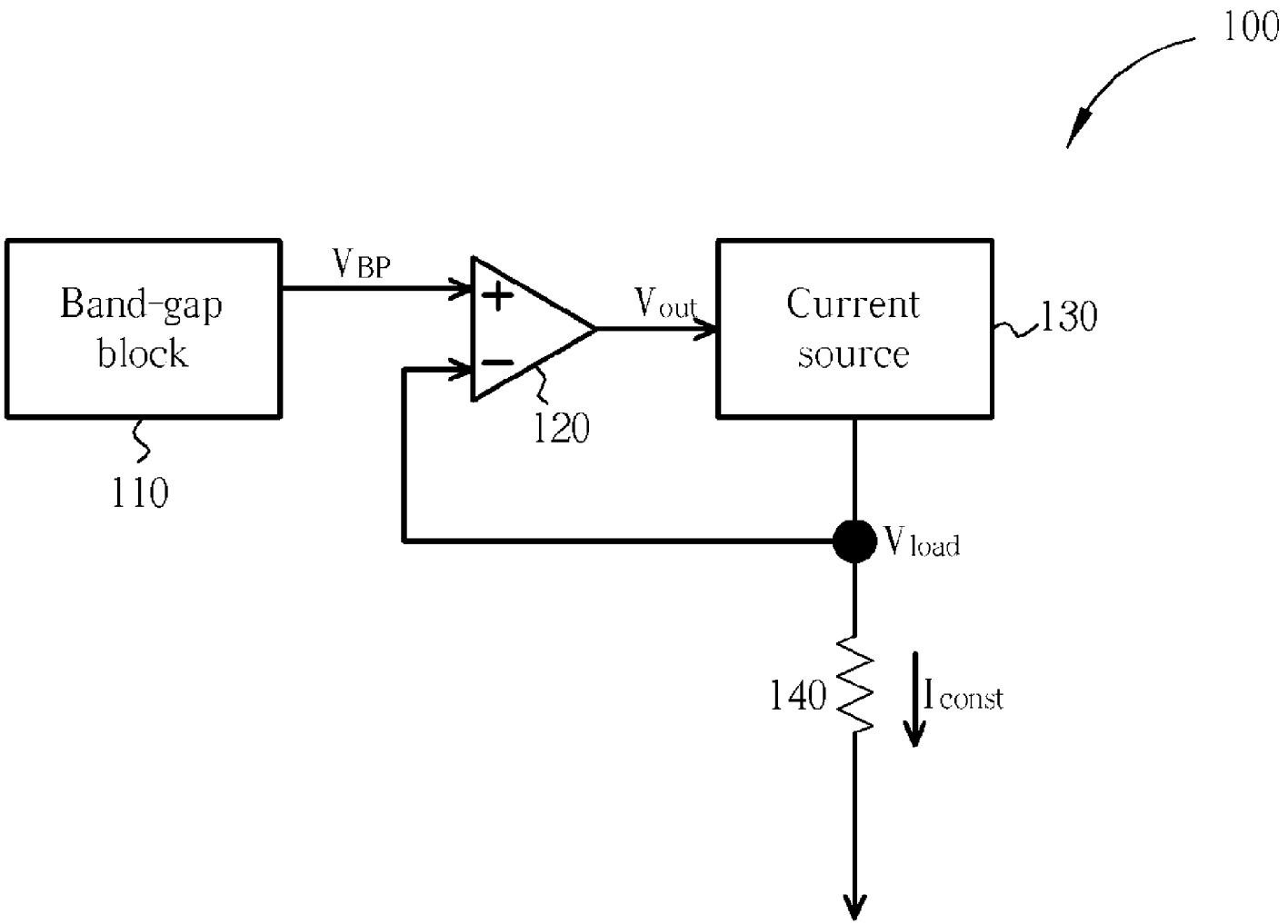
Fig. 1 Related Art
FIG. 1 is a diagram illustrating a structure of a related art constant current source.
Figure 2:
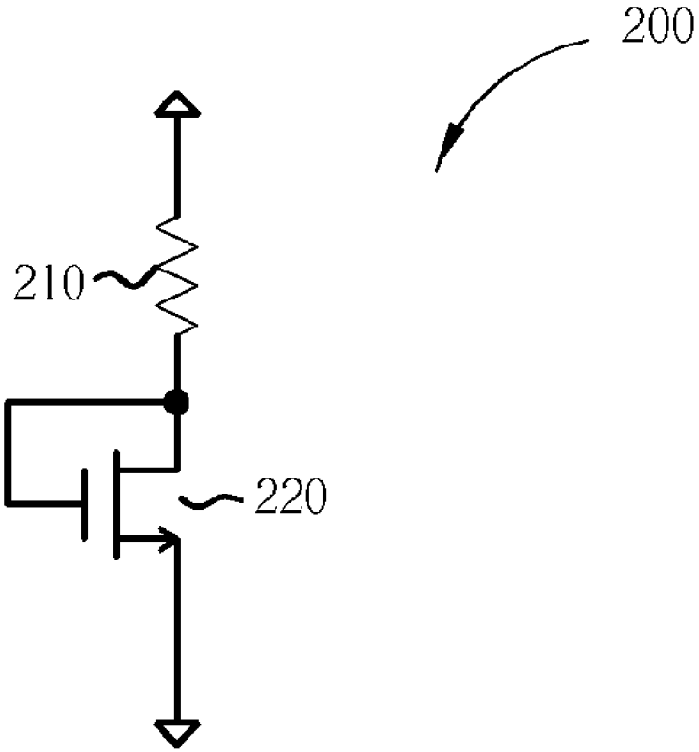
Fig. 2 Related Art
FIG. 2 is a diagram of a compensating load according to the related art.
Figure 3:
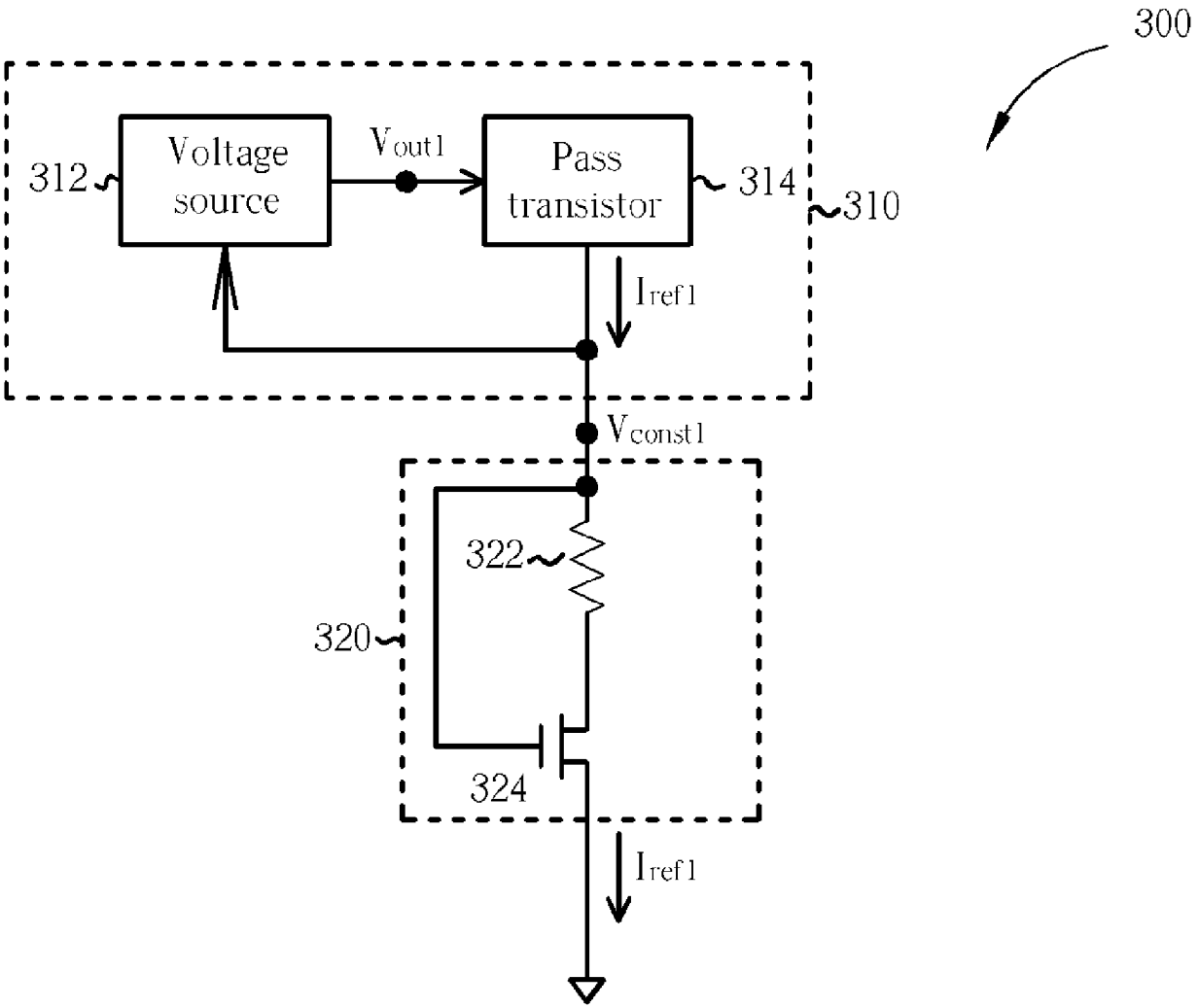
FIG. 3 is a diagram illustrating a constant current source having temperature compensation according to a first embodiment of the present invention.

Please refer to FIG. 3. FIG. 3 is a diagram illustrating a constant current source 300 having temperature compensation according to a first embodiment of the present invention. The constant current source 300 comprises a constant voltage provider 310 and a compensating load 320. The constant voltage provider 310 includes a voltage source 312 and a pass transistor 314. The compensating load 320 includes a resistor 322 and an NMOS transistor 324. The constant voltage provider 310 provides a constant voltage $V_{const1}$ for the compensating load 320. The compensating load 320 provides an overall resistive value to transform the constant voltage $V_{const1}$ into a substantially constant current $I_{ref1}$, which is substantially constant despite the temperature variation. The voltage source 312 holds the constant voltage $V_{const1}$ to be substantially constant by receiving the constant voltage $V_{const1}$ as a negative feedback and outputting an output voltage $V_{out1}$ to the following pass transistor 314. In this embodiment, the pass transistor 314 passes the substantially constant current $I_{ref1}$ and insulates the substantially constant current $I_{ref1}$ from the output voltage $V_{out1}$ of the voltage source 312. The pass transistor 314 can be simply implemented by a MOS transistor, a BJT transistor or any circuit possessing the same functionality as mentioned above. In the compensating load 320, the resistor 322 having a negative temperature coefficient is coupled in series with the NMOS transistor 324, where a gate terminal of the NMOS transistor 324 is coupled to the constant voltage $V_{const1}$. The NMOS transistor 324 operates in a linear region or a saturation region and can be viewed as a compensating resistor with a positive temperature coefficient. Thus, as the compensating load 320 experiences a temperature increase, a resistive value of the resistor 322 declines and at the same time, a resistive value of the NMOS transistor 324 grows. This growth and declination in resistive values can make the overall resistive value of the compensating load 320 substantially constant. On the other hand, as the compensating load 320 experiences a temperature decrease, the resistive value of the resistor 322 grows and at the same time, the resistive value of the NMOS transistor 324 declines. Again, this growth and declination in resistive values will make the overall resistive value of the compensating load 320 substantially constant.

Therefore, when a temperature variation experienced by the compensating load 320 remains in a predetermined range, the overall resistive value provided by the compensating load 320 will be substantially constant, resulting in a substantially constant current $I_{ref1}$. Moreover, by controlling a size of the NMOS transistor 324 and the resistive value of the resistor 322, a temperature coefficient of the overall resistive value of the compensating load 320 can be adjusted to be slightly positive or slightly negative to meet different kinds of application requirements.

Figure 4:
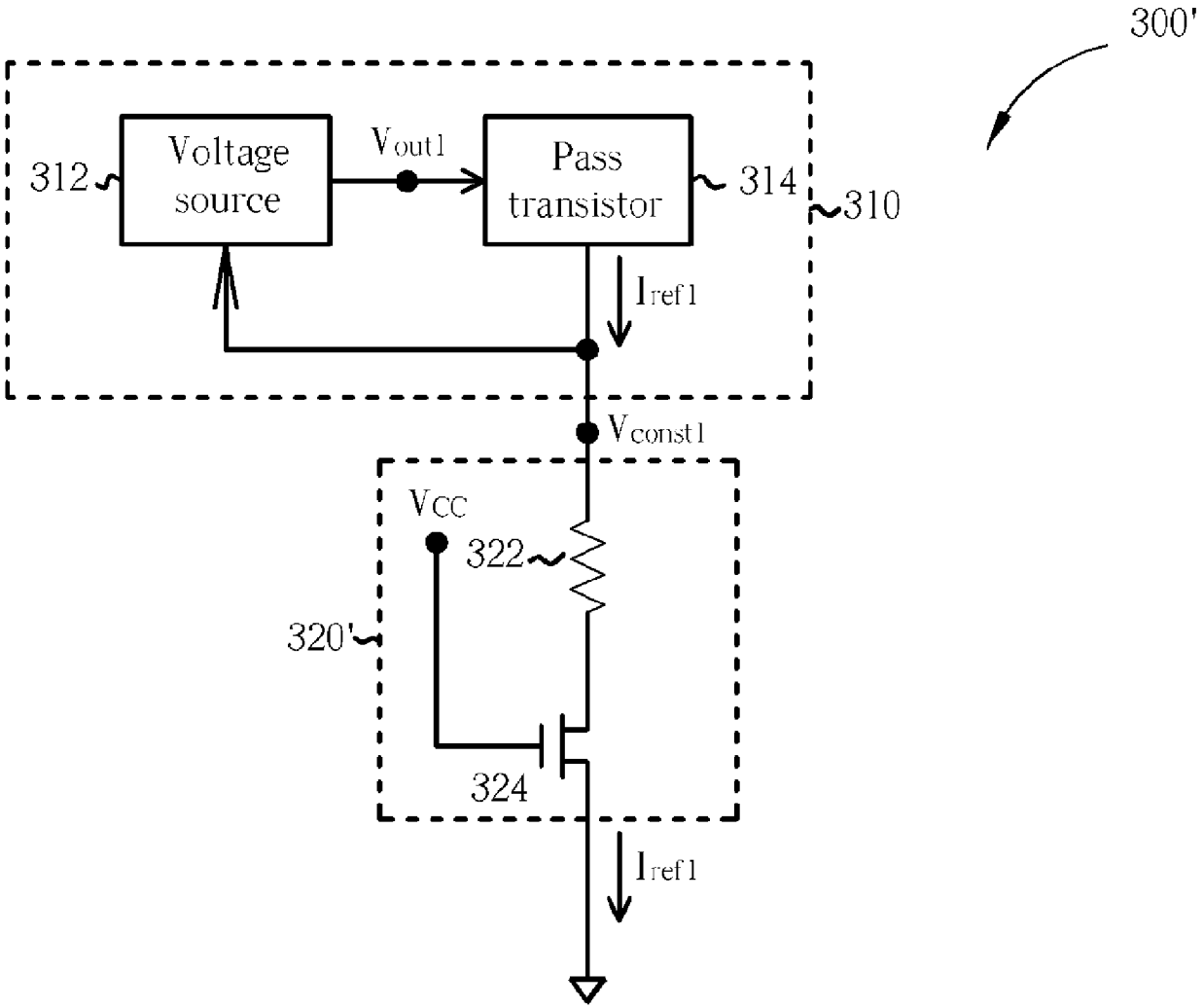
FIG. 4 is a diagram illustrating a constant current source having temperature compensation according to a variation of the first embodiment of the present invention.
Figure 9:
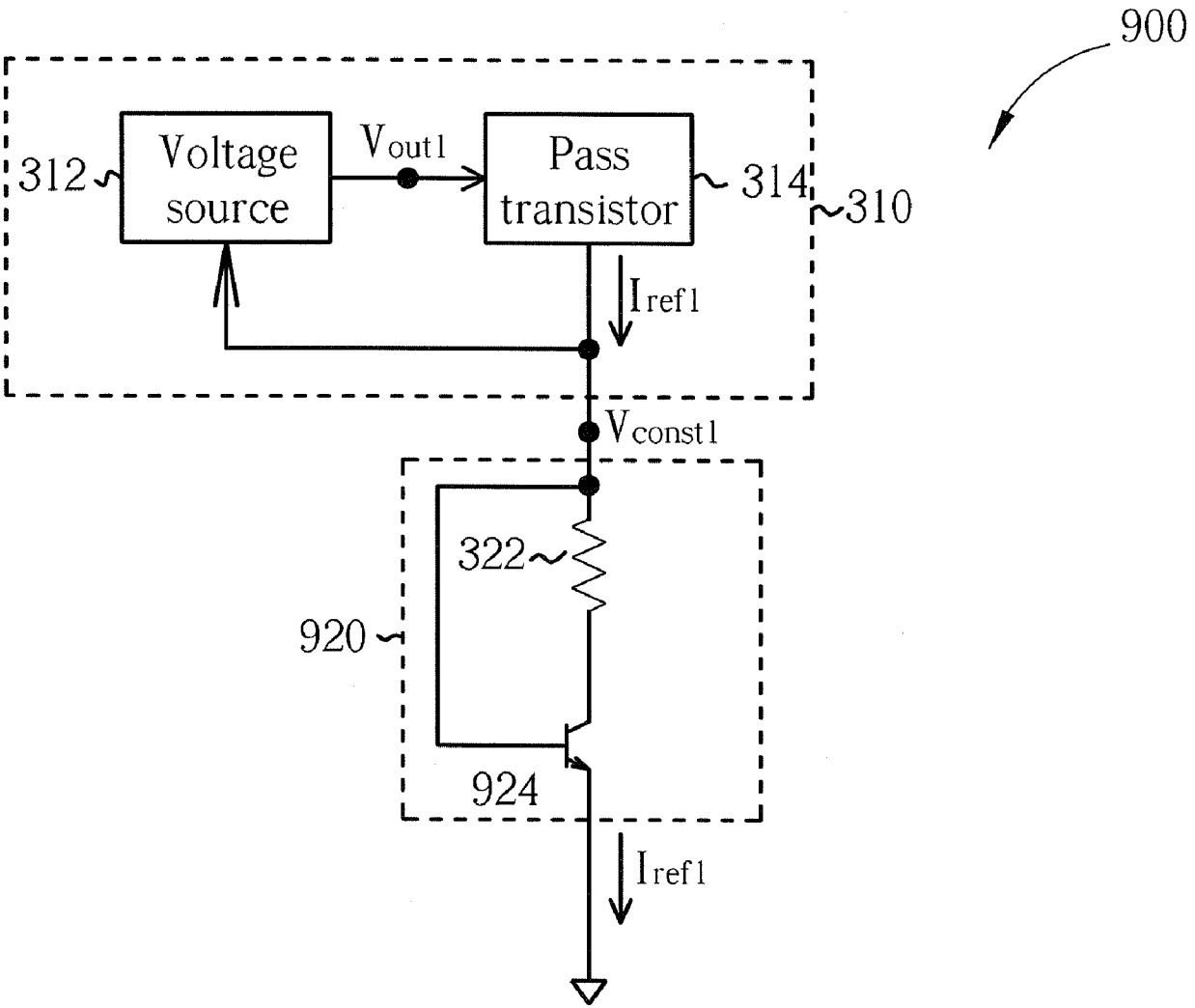
FIG. 9 is a diagram illustrating a constant current source having temperature compensation according to a fifth embodiment of the present invention.
Figure 10:
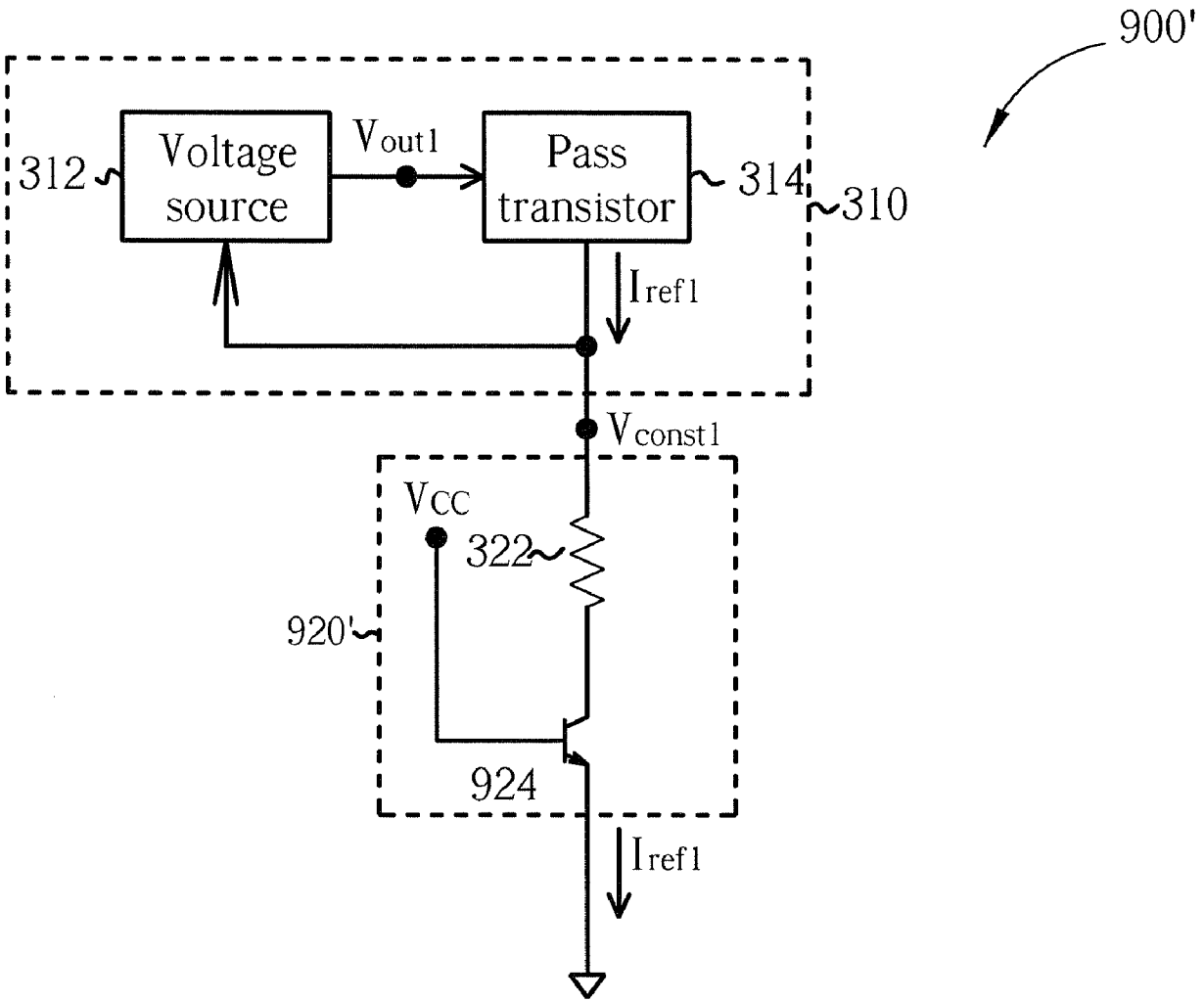
FIG. 10 is a diagram illustrating a constant current source having temperature compensation according to a variation of the fifth embodiment of the present invention.

Please note that according to a variation of the first embodiment, the gate terminal of the NMOS transistor 324, except being coupled to the constant voltage $V_{const1}$, can also be coupled to the supply voltage $V_{CC}$ as shown in FIG. 4. Additionally, the voltage source 312 can be implemented by any device whose functionality matches what is required in this variation of the first embodiment. In addition, the NMOS transistor 324 can be easily replaced by a BJT transistor, while the same functionality provided by the NMOS transistor 324 is still achieved. In such a case, the BJT transistor preferably operates in a saturation region. For example, compared with the compensating load 320 in the constant current source 300 shown in FIG. 3, the compensating load 920 in the exemplary constant current source 900 shown in FIG. 9 includes a BJT transistor 924 having a base terminal coupled to the constant voltage $V_{const1}$; similarly, compared with the compensating load 320' in the constant current source 300' shown in FIG. 4, the compensating load 920' in the exemplary constant current source 900' shown in FIG. 10 includes a BJT transistor 924 having a base terminal coupled to the supply voltage $V_{CC}$.

Figure 5:
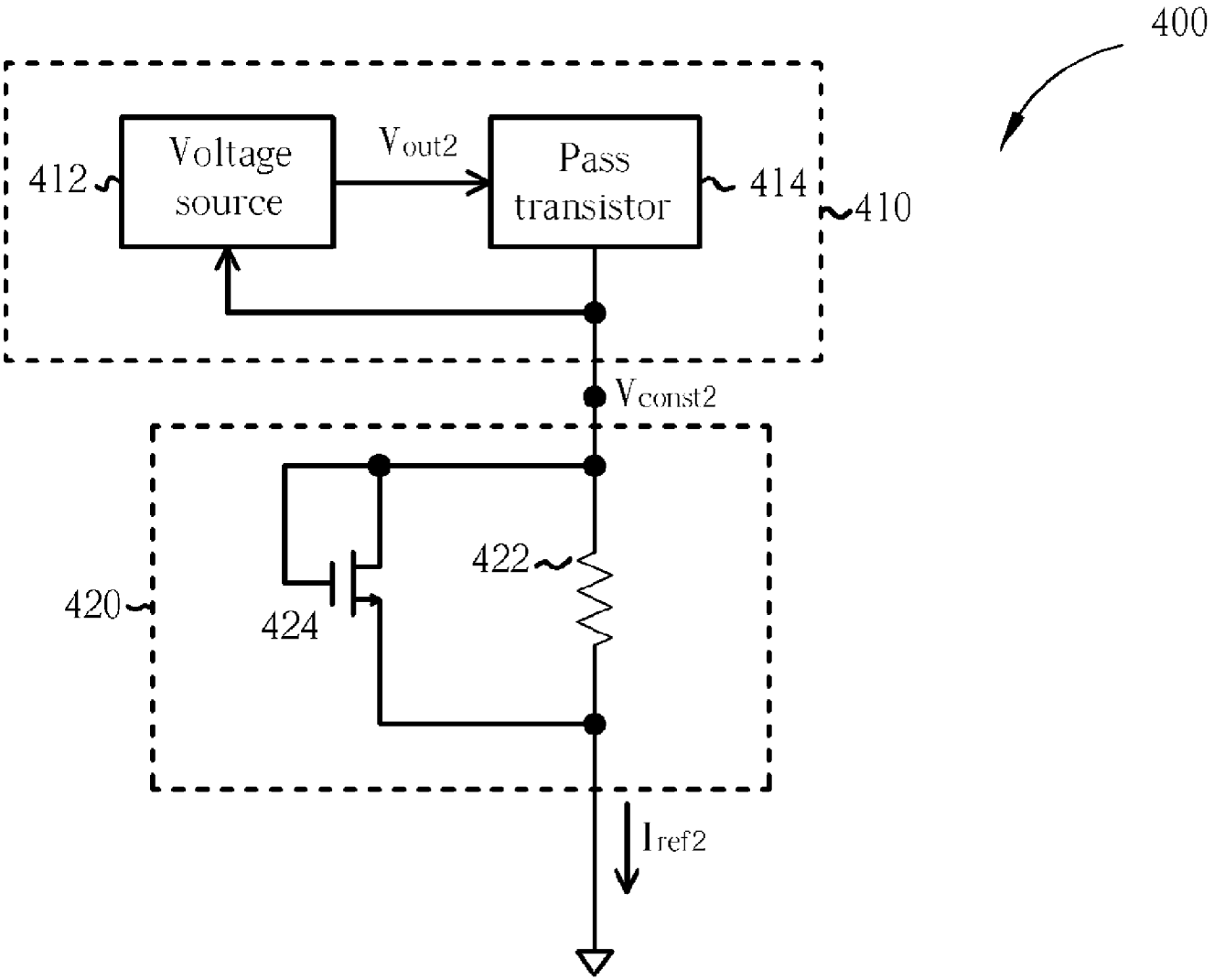
FIG. 5 is a diagram illustrating a constant current source having temperature compensation according to a second embodiment of the present invention.

Please refer to FIG. 5. FIG. 5 is a diagram illustrating a constant current source 400 having temperature compensation according to a second embodiment of the present invention. Similar to the constant current source 300 shown in FIG. 3, the constant current source 400 comprises a constant voltage provider 410 and a compensating load 420. The operation of the constant voltage provider 410 is similar to the constant voltage provider 310 in FIG. 3, and further description is omitted here for brevity. The compensating load 420 includes a resistor 422 and an NMOS transistor 424. In the compensating load 420, the resistor 422 having a negative temperature coefficient is coupled in parallel with the NMOS transistor 424, where a gate terminal and a drain terminal of the NMOS transistor 424 are both coupled to the constant voltage $V_{const2}$. The NMOS transistor 424 operates in a linear region or a saturation region and can be viewed as a compensating resistor with a positive temperature coefficient. Thus, as the compensating load 420 experiences a temperature increase, a resistive value of the resistor 422 declines and at the same time, a resistive value of the NMOS transistor 424 grows. This growth and declination in resistive values can make an overall resistive value of the compensating load 420 substantially constant. On the other hand, as the compensating load 420 experiences a temperature decrease, the resistive value of the resistor 422 grows and at the same time, the resistive value of the NMOS transistor 424 declines. Again, this growth and declination in resistive values will make the overall resistive value of the compensating load 420 substantially constant.

Therefore, when the compensating load 420 experiences a temperature variation and the temperature variation remains in a predetermined range, the overall resistive value provided by the compensating load 420 will be substantially constant, resulting in a substantially constant current $I_{ref2}$. Moreover, by controlling a size of the NMOS transistor 424 and the resistive value of the resistor 422, a temperature coefficient of the overall resistive value of the compensating load 420 can be adjusted to be slightly positive or slightly negative to meet different kinds of application requirements.

Figure 6:
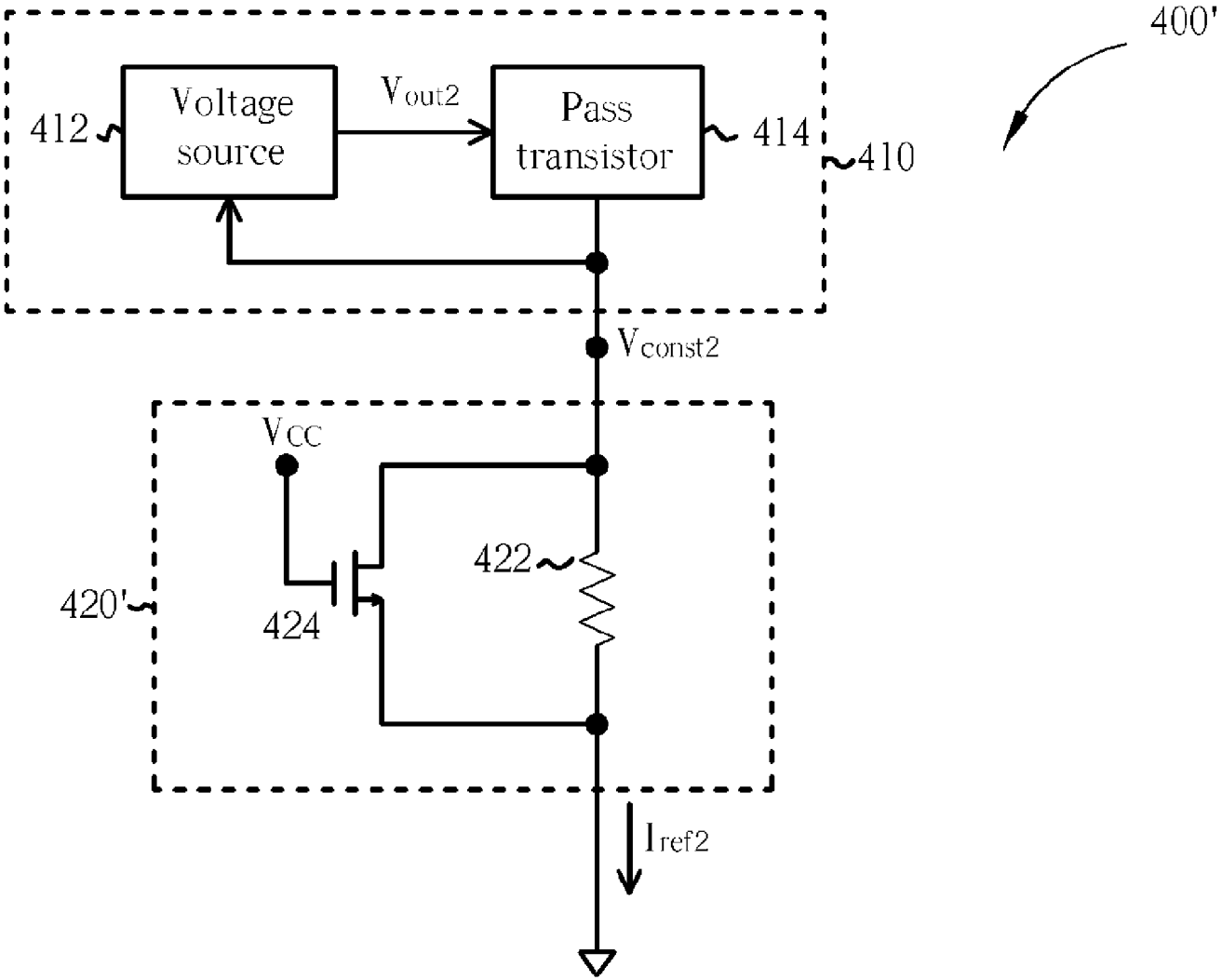
FIG. 6 is a diagram illustrating a constant current source having temperature compensation according to a variation of the second embodiment of the present invention.
Figure 11:
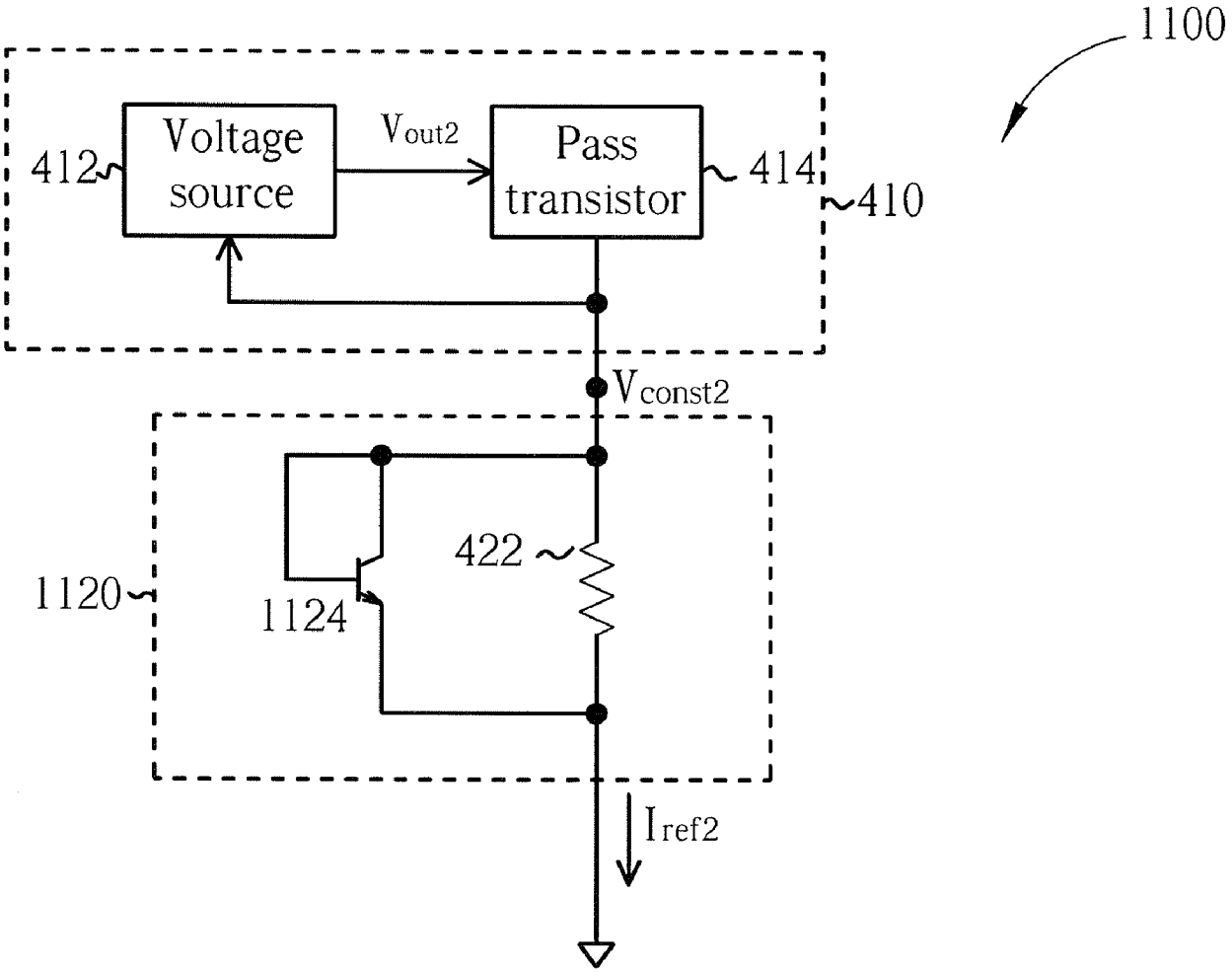
FIG. 11 is a diagram illustrating a constant current source having temperature compensation according to a sixth embodiment of the present invention.
Figure 12:
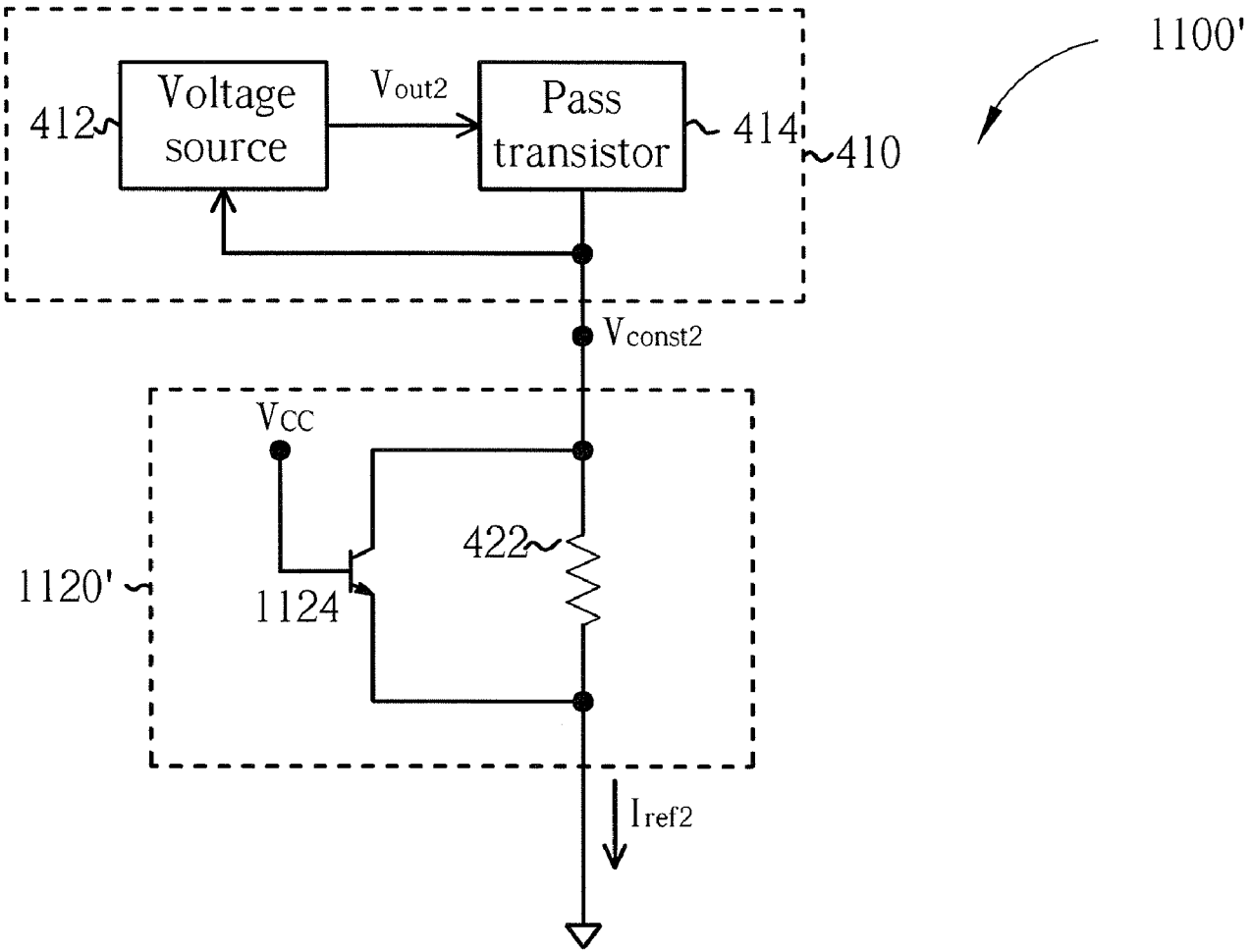
FIG. 12 is a diagram illustrating a constant current source having temperature compensation according to a variation of the sixth embodiment of the present invention.

Please note that according to a variation of the second embodiment, the gate terminal of the NMOS transistor 424, except being coupled to the constant voltage $V_{const2}$, can also be coupled to a supply voltage $V_{CC}$ as shown in FIG. 6. Additionally, the voltage source 412 can be implemented by any device whose functionality matches what is required in this variation of the second embodiment. In addition, the NMOS transistor 424 can be easily replaced by a BJT transistor, while the same functionality provided by the NMOS transistor 424 is still achieved. In such a case, the BJT transistor preferably operates in a saturation region. For example, compared with the compensating load 420 in the constant current source 400 shown in FIG. 5, the compensating load 1120 in the exemplary constant current source 1100 shown in FIG. 11 includes a BJT transistor 1124 having a base terminal coupled to the constant voltage $V_{const2}$; similarly, compared with the compensating load 420' in the constant current source 400' shown in FIG. 6, the compensating load 1120' in the exemplary constant current source 1100' shown in FIG. 12 includes a BJT transistor 1124 having a base terminal coupled to the supply voltage $V_{CC}$.

Figure 7:
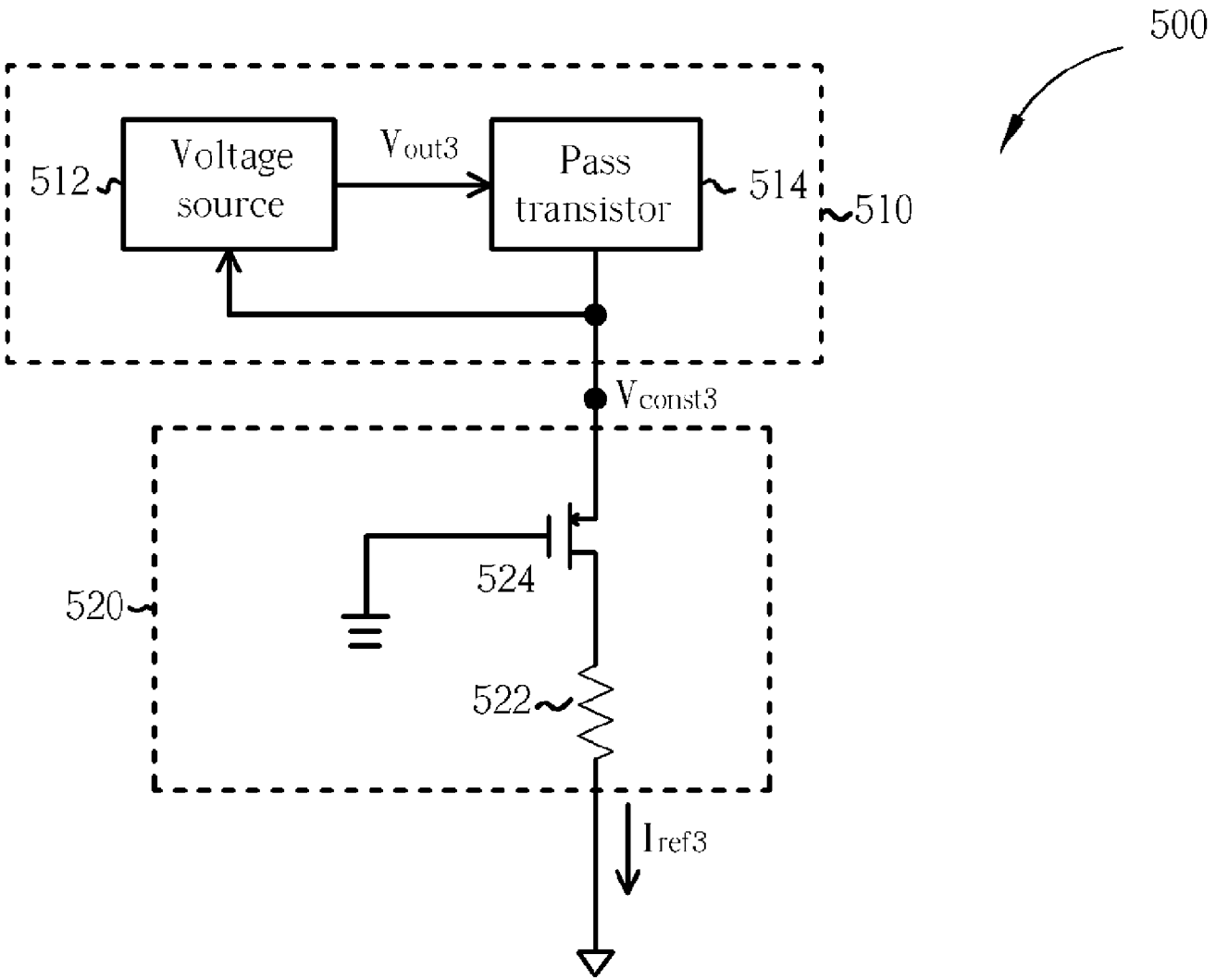
FIG. 7 is a diagram illustrating a constant current source having temperature compensation according to a third embodiment of the present invention.

Please refer to FIG. 7. FIG. 7 is a diagram illustrating a constant current source 500 having temperature compensation according to a third embodiment of the present invention. Similar to the constant current source 300 in FIG. 3, the constant current source 500 comprises a constant voltage provider 510 and a compensating load 520. The operation of the constant voltage provider 510 is similar to the constant voltage provider 310 in FIG. 3, and further description is omitted here for brevity. The compensating load 520 includes a resistor 522 and a PMOS transistor 524. The resistor 522 having a negative temperature coefficient is coupled in series with the PMOS transistor 524, where a gate terminal of the PMOS transistor 524 is coupled to the ground. The PMOS transistor 524 operates in a linear region or a saturation region and can be viewed as a compensating resistor with a positive temperature coefficient. Thus, as the compensating load 520 experiences a temperature increase, a resistive value of the resistor 522 declines and at the same time, a resistive value of the PMOS transistor 524 grows. This growth and declination in resistive values can make an overall resistive value of the compensating load 520 substantially constant. On the other hand, as the compensating load 520 experiences a temperature decreases, the resistive value of the resistor 522 grows and at the same time, the resistive value of the PMOS transistor 524 transistor declines. Again, this growth and declination in resistive values will make the overall resistive value of the compensating load 520 substantially constant.

Figure 13:
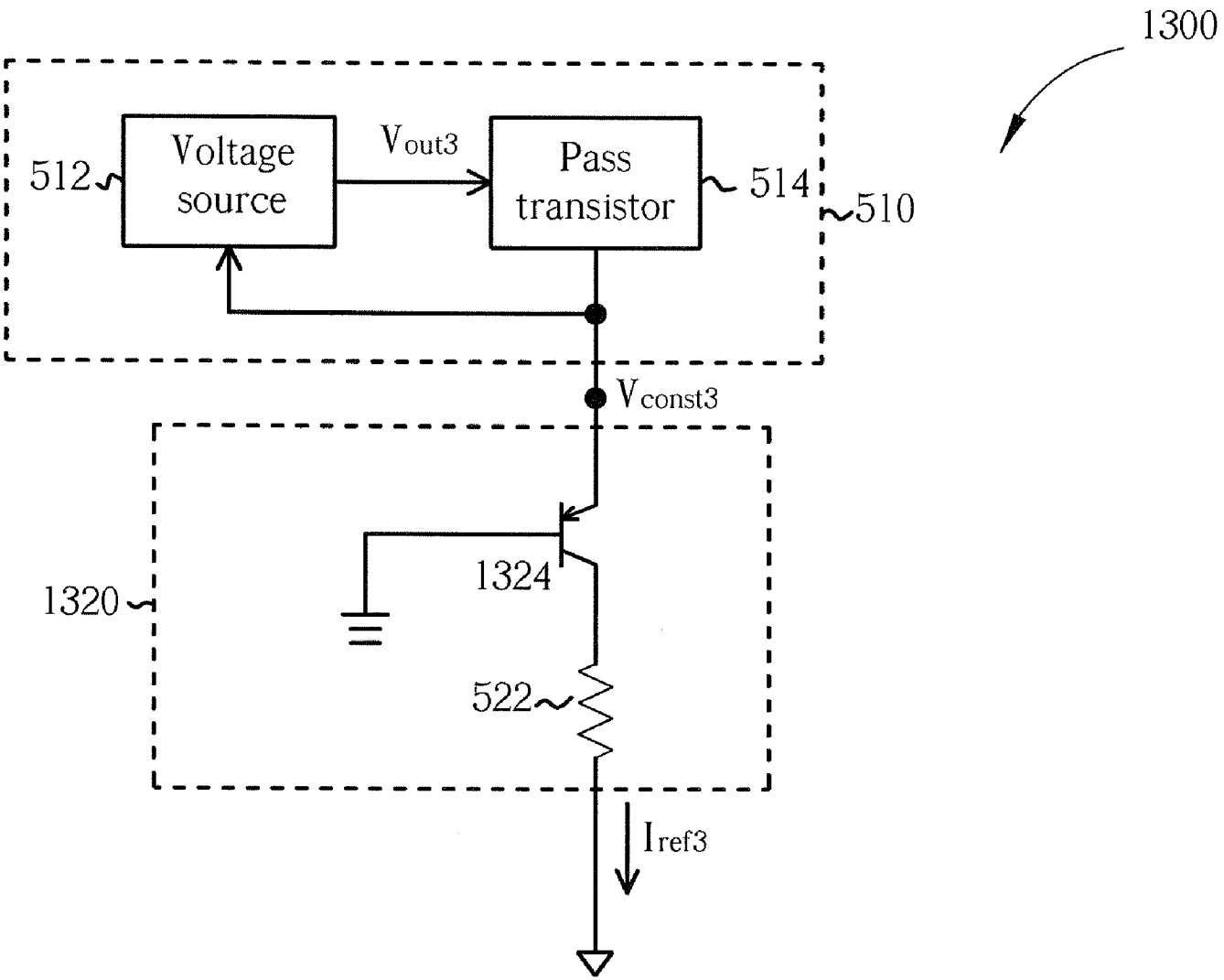
FIG. 13 is a diagram illustrating a constant current source having temperature compensation according to a seventh embodiment of the present invention.

Therefore, when the compensating load 520 experiences a temperature variation and the temperature variation remains in a predetermined range, the overall resistive value provided by the compensating load 520 will be substantially constant, resulting in a substantially constant current $I_{ref3}$. Moreover, by controlling a size of the PMOS transistor 524 and the resistive value of the resistor 522, a temperature coefficient of the overall resistive value of the compensating load 520 can be adjusted to be slightly positive or slightly negative to meet different kinds of application requirements. Please note that the PMOS transistor 524 can be easily replaced by a BJT transistor, while the same functionality provided by the PMOS transistor 524 is still achieved. In such a case, the BJT transistor preferably operates in a saturation region. For example, compared with the compensating load 520 in the constant current source 500 shown in FIG. 7, the compensating load 1320 in the exemplary constant current source 1300 shown in FIG. 13 includes a BJT transistor 1324 having a base terminal coupled to the ground.

Figure 8:
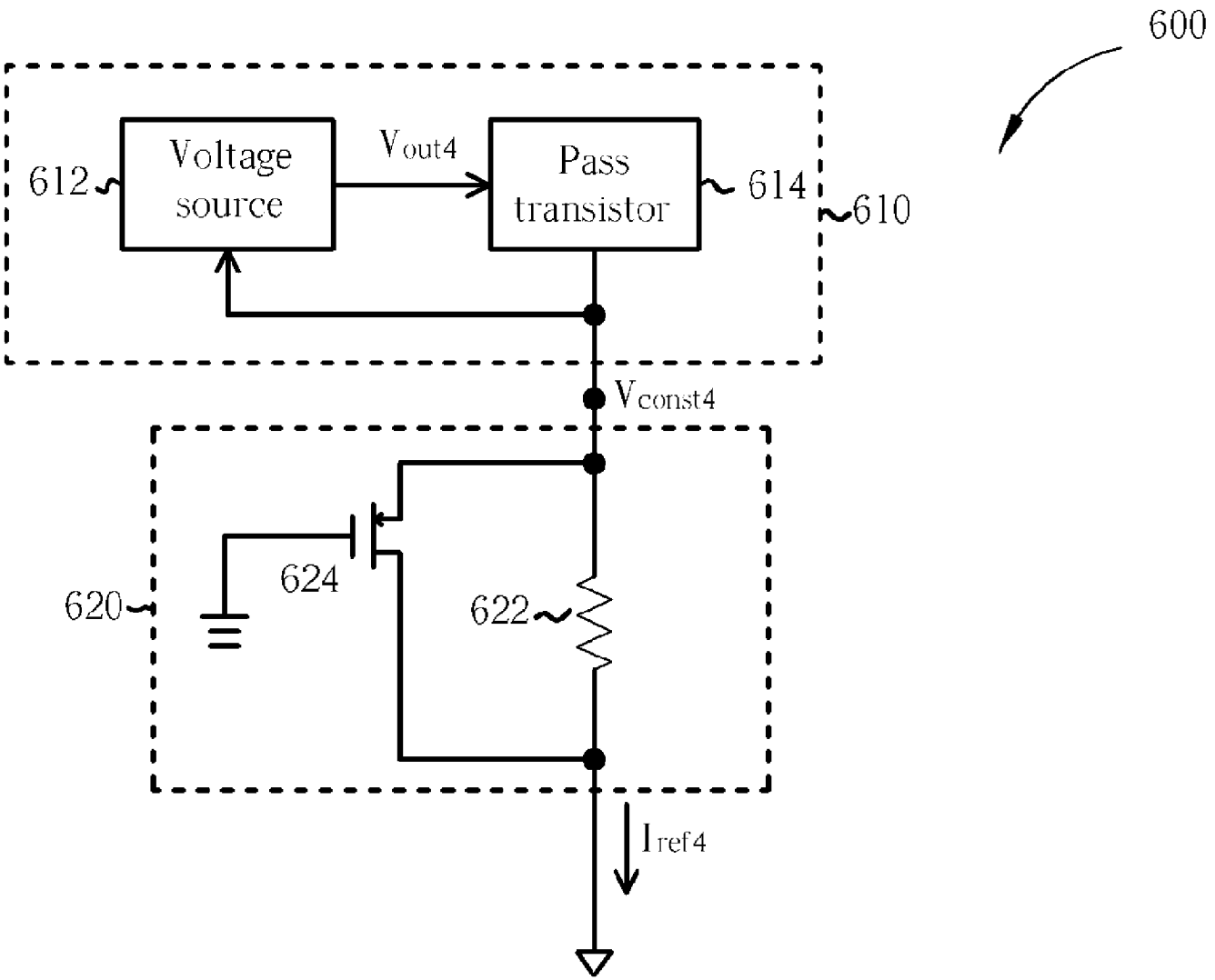
FIG. 8 is a diagram illustrating a constant current source having temperature compensation according to a fourth embodiment of the present invention.

Please refer to FIG. 8. FIG. 8 is a diagram illustrating a constant current source 600 having temperature compensation according to a fourth embodiment of the present invention. Similar to the constant current source 300 in FIG. 3, the constant current source 500 comprises a constant voltage provider 610 and a compensating load 620. The operation of the constant voltage provider 610 is similar to the constant voltage provider 310 in FIG. 3, and detailed description is omitted here for brevity. The compensating load 620 includes a resistor 622 and a PMOS transistor 624. The resistor 622 having a negative temperature coefficient is coupled in parallel with the PMOS transistor 624, where a gate terminal of the PMOS transistor 624 is coupled to the ground. The PMOS transistor 624 operates in a linear region or a saturation region and can be viewed as a compensating resistor with a positive temperature coefficient. Thus, as the compensating load 620 experiences a temperature increase, a resistive value of the resistor 622 declines and at the same time, a resistive value of the PMOS transistor 624 grows. This growth and declination in resistive values can make an overall resistive value of the compensating load 620 substantially constant. On the other hand, as the compensating load 620 experiences a temperature decreases, the resistive value of the resistor 622 grows and at the same time, the resistive value of the PMOS transistor 624 declines. Again, this growth and declination in resistive values will make the overall resistive value of the compensating load 620 substantially constant.

Figure 14:
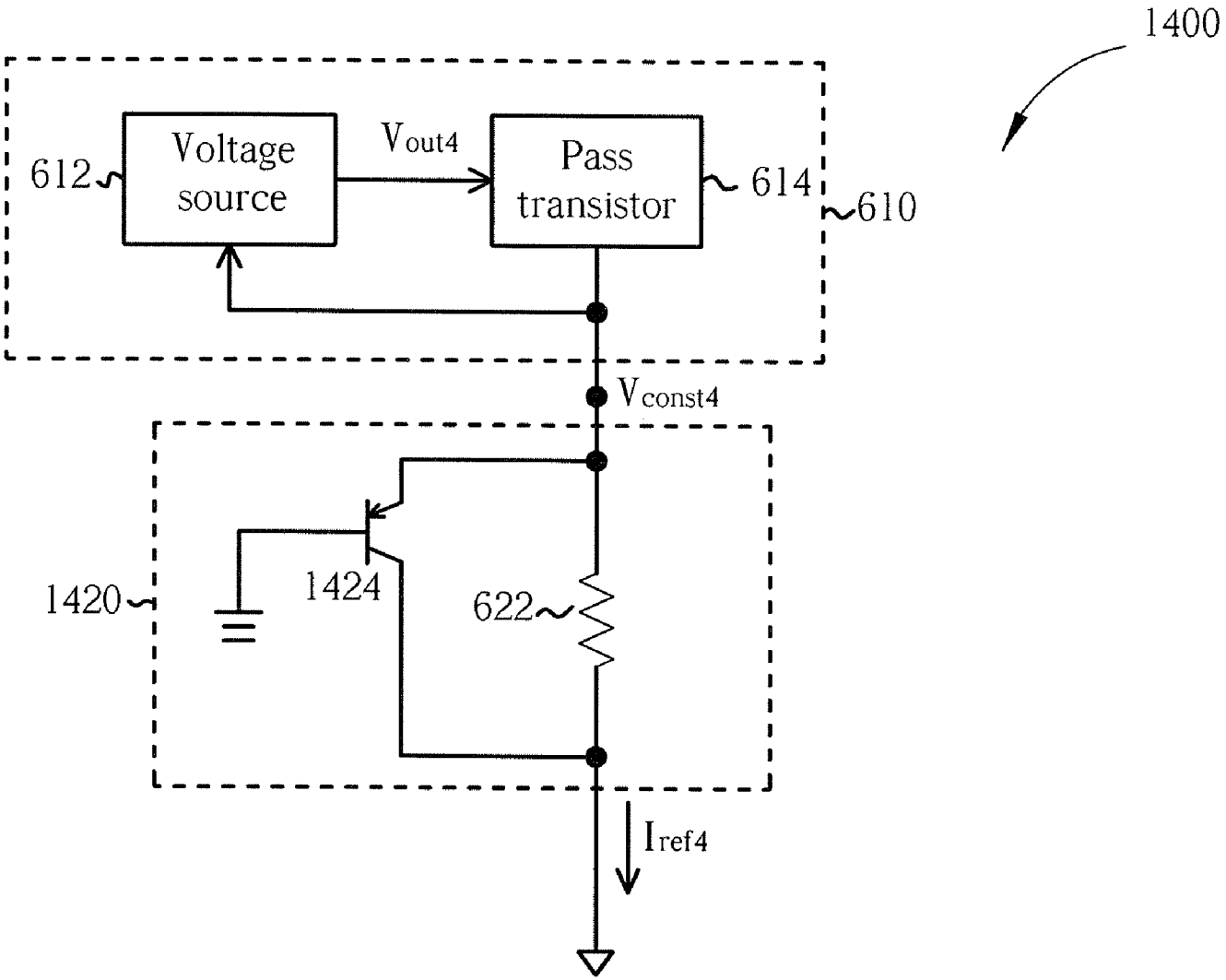
FIG. 14 is a diagram illustrating a constant current source having temperature compensation according to an eighth embodiment of the present invention.

Therefore, when the compensating load 620 experiences a temperature variation and the temperature variation remains in a predetermined range, the overall resistive value provided by the compensating load 620 will be substantially constant, resulting in a substantially constant current $I_{ref4}$. Moreover, by controlling a size of the PMOS transistor 624 and the resistive value of the resistor 622, a temperature coefficient of the overall resistive value of the compensating load 620 can be adjusted to be slightly positive or slightly negative to meet different kinds of application requirements. Please note that the PMOS transistor 624 can be easily replaced by a BJT transistor, while the same functionality provided by the PMOS transistor 624 is still achieved. In such a case, the BJT transistor preferably operates in a saturation region. For example, compared with the compensating load 620 in the constant current source 600 shown in FIG. 8, the compensating load 1420 in the exemplary constant current source 1400 shown in FIG. 14 includes a BJT transistor 1424 having a base terminal coupled to the ground.

In contrast to the related art, the device having temperature compensation according to the present invention is capable of providing a compensating unit, which has a positive temperature coefficient and is coupled in series or in parallel to the resistor, for compensating a resistance variation of the resistor for a temperature variation. Therefore, with the help of the compensating unit, the current passing through the resistor is stabilized.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A device having temperature compensation, comprising:

a constant voltage provider for providing a constant voltage; and a compensating load coupled to the constant voltage provider for providing a resistive load to transform the constant voltage into a substantially constant current, the compensating load comprising:

a resistor, having a negative temperature coefficient and coupled to the constant voltage; and a compensating unit, having a positive temperature coefficient and coupled in series to the resistor, for compensating a resistance variation of the resistor for a temperature variation, wherein the compensating unit is a PMOS transistor operating in a linear region or a saturation region.

2. The device of claim 1, wherein the constant voltage provider comprises:

a voltage source for receiving the constant voltage as a negative feedback to generate a voltage output; and a pass transistor coupled to the voltage output and the constant voltage for passing the substantially constant current and insulating the substantially constant current from the voltage source.

3. A device having temperature compensation, comprising:

a constant voltage provider for providing a constant voltage; and a compensating load coupled to the constant voltage provider for providing a resistive load to transform the constant voltage into a substantially constant current, the compensating load comprising:

a resistor, having a negative temperature coefficient and coupled to the constant voltage; and a compensating unit, having a positive temperature coefficient and coupled in series to the resistor, for compensating a resistance variation of the resistor for a temperature variation, wherein the compensating unit is an NMOS transistor operating in a linear region or a saturation region.

4. The device of claim 3, wherein the constant voltage provider comprises:

a voltage source for receiving the constant voltage as a negative feedback to generate a voltage output; and a pass transistor coupled to the voltage output and the constant voltage for passing the substantially constant current and insulating the substantially constant current from the voltage source.

5. The device of claim 3, wherein a gate terminal of the NMOS transistor is coupled to the constant voltage.

6. The device of claim 3, wherein a gate terminal of the NMOS transistor is coupled to a supply voltage.

7. A device having temperature compensation, comprising:

a constant voltage provider for providing a constant voltage; and a compensating load coupled to the constant voltage provider for providing a resistive load to transform the constant voltage into a substantially constant current, the compensating load comprising:

a resistor, having a negative temperature coefficient and coupled to the constant voltage; and a compensating unit, having a positive temperature coefficient and coupled in series to the resistor, for compensating a resistance variation of the resistor for a temperature variation, wherein the compensating unit is a BJT transistor operating in a saturation region.

8. The device of claim 7, wherein a base terminal of the BJT transistor is coupled to the constant voltage.

9. The device of claim 7, wherein a base terminal of the BJT transistor is coupled to a supply voltage.

10. The device of claim 7, wherein the constant voltage provider comprises:

a voltage source for receiving the constant voltage as a negative feedback to generate a voltage output; and a pass transistor coupled to the voltage output and the constant voltage for passing the substantially constant current and insulating the substantially constant current from the voltage source.

11. A device having temperature compensation, comprising:

a constant voltage provider for providing a constant voltage; and a compensating load coupled to the constant voltage provider for providing a resistive load to transform the constant voltage into a substantially constant current, the compensating load comprising:

a resistor, having a negative temperature coefficient and coupled to the constant voltage; and a compensating unit, having a positive temperature coefficient and coupled in parallel to the resistor, for compensating a resistance variation of the resistor for a temperature variation, wherein the compensating unit is a PMOS transistor operating in a linear region or a saturation region.

12. The device of claim 11, wherein the constant voltage provider comprises:

a voltage source for receiving the constant voltage as a negative feedback to generate a voltage output; and a pass transistor coupled to the voltage output and the constant voltage for passing the substantially constant current and insulating the substantially constant current from the voltage source.

13. A device having temperature compensation, comprising:

a constant voltage provider for providing a constant voltage; and a compensating load coupled to the constant voltage provider for providing a resistive load to transform the constant voltage into a substantially constant current, the compensating load comprising:

a resistor, having a negative temperature coefficient and coupled to the constant voltage; and a compensating unit, having a positive temperature coefficient and coupled in parallel to the resistor, for compensating a resistance variation of the resistor for a temperature variation, wherein the compensating unit is an NMOS transistor operating in a linear region or a saturation region, and a gate terminal of the NMOS transistor is coupled to a supply voltage.

14. The device of claim 13, wherein the constant voltage provider comprises:

a voltage source for receiving the constant voltage as a negative feedback to generate a voltage output; and a pass transistor coupled to the voltage output and the constant voltage for passing the substantially constant current and insulating the substantially constant current from the voltage source.

15. A device having temperature compensation, comprising:

a constant voltage provider for providing a constant voltage; and a compensating load coupled to the constant voltage provider for providing a resistive load to transform the constant voltage into a substantially constant current, the compensating load comprising:

a resistor, having a negative temperature coefficient and coupled to the constant voltage; and a compensating unit, having a positive temperature coefficient and coupled in parallel to the resistor, for compensating a resistance variation of the resistor for a temperature variation, wherein the compensating unit is a BJT transistor operating in a saturation region.

16. The device of claim 15, wherein the constant voltage provider comprises:

a voltage source for receiving the constant voltage as a negative feedback to generate a voltage output; and a pass transistor coupled to the voltage output and the constant voltage for passing the substantially constant current and insulating the substantially constant current from the voltage source.

17. The device of claim 15, wherein a base terminal of the BJT transistor is coupled to the constant voltage.

18. The device of claim 15, wherein a base terminal of the BJT transistor is coupled to a supply voltage.

* * * * *